United States Patent [19]

Umeda

[11] Patent Number: 4,917,059

[45] Date of Patent: Apr. 17, 1990

[54] VALVE LASH ADJUSTER

[75] Inventor: Minao Umeda, Maebashi, Japan

[73] Assignee: Nippon Seiko Kabushiki Kaisha, Tokyo, Japan

[21] Appl. No.: 254,815

[22] Filed: Oct. 7, 1988

[30] Foreign Application Priority Data

Mar. 31, 1988 [JP] Japan ..... 63-42032[U]

[51] Int. Cl.[4] ..... F01L 1/14; F01L 1/24

[52] U.S. Cl. ..... 123/90.55; 123/90.46; 123/90.43

[58] Field of Search ..... 123/90.35, 90.36, 90.41, 123/90.43, 90.46, 90.48, 90.49, 90.52, 90.55, 90.56, 90.57

[56] References Cited

U.S. PATENT DOCUMENTS

| | | | |
|---|---|---|---|
| 2,908,260 | 10/1959 | Bergmann | 123/90.57 |
| 4,098,240 | 7/1978 | Abell, Jr. | 123/90.55 |
| 4,228,771 | 10/1980 | Krieg | 123/90.55 |
| 4,387,675 | 6/1983 | Hori et al. | 123/90.55 |
| 4,463,714 | 8/1984 | Nakamura | 123/90.52 |
| 4,596,213 | 6/1986 | Hillebrand | 123/90.46 |

FOREIGN PATENT DOCUMENTS

| | | | |
|---|---|---|---|
| 2847699 | 5/1980 | Fed. Rep. of Germany | 123/90.55 |
| 2032039 | 4/1980 | United Kingdom | 123/90.55 |

*Primary Examiner*—Willis R. Wolfe

*Assistant Examiner*—Weilun Lo

*Attorney, Agent, or Firm*—Shapiro and Shapiro

[57] ABSTRACT

A valve lash adjuster has a body generally having a bottomed cylindrical shape and formed with a high pressure chamber and with a supply hole for supplying operating oil to a cylinder portion, and a plunger assembly generally having a cylindrical shape and relatively movably fitted in a hollow portion of the body and holding a storing device for storing operating oil supplied from the outside through the body. The plunger assembly is formed with an axial hole on one side of the storing device for communicating the storing device with the high pressure chamber. On the other side of the storing device, the plunger assembly is formed with a first passageway for communicating the storing device with the exterior of the plunger assembly, and a second passageway branching off from the first passageway and opening to the outer peripheral surface of the plunger assembly at an opening portion opposed to the supply hole of the body. A valve mechanism is disposed on the plunger assembly and adapted to open to permit the operating oil in the storing device to flow into the high pressure chamber when the plunger assembly moves in a direction to protrude relative to the body, and to close to block the operating oil when the plunger assembly moves in the opposite direction relative to the body.

6 Claims, 2 Drawing Sheets

VALVE LASH ADJUSTER

BACKGROUND OF THE INVENTION

1. Field of the Invention

This invention relates to improvements in a valve lash adjuster used in an conventional internal combustion engine having an intake and exhaust valve.

2. Related Background Art

In said internal combustion engine, a predetermined valve clearance is preset to effect appropriate sealing of the intake and exhaust valve, with the difference between the expansion of a cylinder head and the expansion of a valve motion system element by the heat during operation being taken into account.

However, abrasion or the like of each portion of the valve motion system element may sometimes occur over the long-time continued use of the engine and the actual valve clearance may become large. An increase in the valve clearance deteriorates the performance of the internal combustion engine and increases noise, and in some cases can increase the concentration of noxious exhaust gases. To prevent such Problems, the check-up and adjustment of the valve clearance are necessary, but this is a timeconsuming and cumbersome task. A lash adjuster can effectively solve this problem, and automatically maintains the valve clearance at a proper magnitude (usually almost zero).

There are various forms of valve motion system using a valve lash adjuster. Here, description will be made of the general action of a lash adjuster in a valve motion system of the type as shown, for example, in FIG. 4 of the accompanying drawings.

Referring to FIG. 4 which is a cross-sectional view obtained by sectioning a portion of the cylinder head of a popular OHC type internal combustion engine, a lash adjuster 100 is disposed at a predetermined location in the cylinder head 102. One end of a swing arm 104 bears against the head of the lash adjuster 100, and this swing arm 104 swings about the head of the lash adjuster 100 during the operation of the internal combustion engine.

The upper end surface of an intake or exhaust valve 106 bears against the underside of the other end of the swing arm 104, and the intake or exhaust valve 106 is biased upwardly, i.e., in a direction to close the intake or exhaust valve 106, by a spring 108. A cam 110 fixed to a cam shaft 112 is capable of contacting with the lower contact surface 114 of the swing arm 104. The swing arm 104 is pressed toward the cam 110 by the lash adjuster 100 and the valve 106, and the clearance between the two is zero.

The lash adjuster 100 quickly expands in a direction to extend and contracts only somewhat in a direction to retract even if a strong extraneous force is applied thereto, and this will be described later.

When the engine is started from the condition of FIG. 4, the cam shaft 112, namely, the cam 110, rotates and the portion from the base circle 118 thereof to a cam nose 120 contacts with the contact surface 114, and the cam nose 120 presses the swing arm 104. However, as described above, the lash adjuster 100 does not contract even if an extraneous force is applied thereto and therefore, the swing arm 104 pivots clockwise about the head of the lash adjuster 100. As a result, the other end (the right end) of the swing arm 104 depresses the valve 106 and effects the opening operation of the valve 106.

When the cam 110 further rotates and the cam nose 120 returns to its position of FIG. 4, the other end (the right end) of the swing arm 104 moves upward with the retracting movement of the cam nose 120 because the swing arm 104 is pressed upward toward the cam 110 by the biasing force of the spring 108 through the valve 106, whereby the closing operation of the valve 106 is effected.

Thus, the lash adjuster 110 absorbs the variations in the various portions of the valve motion system caused by the thermal expansion and wear thereof, whereby the clearance between the contact surface 114 of the swing arm 104 and the cam 110 becomes zero and undesirable effects such as noise, etc. can be prevented.

Various types of lash adjuster are known, and may be divided broadly into two types:a type which contains operating oil therein and a type in which operating oil is supplied from the outside. A conventional example of the latter type will hereinafter be described with reference to FIG. 5 of the accompanying drawings.

As shown in FIG. 5, the valve lash adjuster is of a bottomed cylindrical shape, and comprises a body 70 and a plunger assembly 72 fitted to each other, a separator 74 for separating operating oil having air mixed therewith, a reservoir 76 for storing the operating oil therein, and a ball valve 80 for permitting or blocking the supply of the operating oil to a high pressure chamber 78. The separator 74 serves to prevent the operating oil supplied from a supply hole 84 from directly coming into the reservoir 76, thereby preventing the operating oil having air mixed therewith from whirling in the reservoir 76.

The valve lash adjusters of this type may also be divided into two types, i.e., a type in which a plunger **72*a* and a plunger cap 72*b* are separate from each other, and a type in which they are integral with each other. Both types exhibit significant disadvantages. That is, in the separate type, where the separator 74 is pressed into the plunger, the thicknesses of the two members are too small to keep a predetermined press-in force, and the control of the press-in tolerance is not simple. Also, where the separator 74 and the plunger cap 72*b* are coupled together as by welding, it becomes necessary to grind the outer diameter after welding. However, during grinding, dust is produced which stays between the plunger cap 72*b* and the separator 74**. The dust must be removed as by washing, but this removing work is difficult.

On the other hand, in an adjuster in which the plunger **72*a* and the plunger cap 72*b* are integral with each other, the separator 74 is placed into the plunger 72. That is, the separator 74 is installed in the plunger cap 72*b* separate from the plunger 72*a***, whereafter the two are united together. Accordingly, the number of steps for assembly is increased, thus resulting in an increased manufacturing cost.

Also, the engine may sometimes stop with the cam nose 120 bearing against the contact surface 114 with the swing arm 104. When such a stopped condition persists, the great biasing force of the spring 108 (biasing the intake or exhaust valve bearing against the underside of one end of the swing arm 104 to its closed position) overcomes the biasing force of the spring 79 in the high pressure chamber 78 of the lash adjuster, and one end of the swing arm 104 is subjected to an upward movement by the intake and exhaust valve. As a result, a downward moment acts on the lash adjuster 100 bearing against the other end of the swing arm 104, and further, a downward pressure force by the cam nose 120 also acts on the lash adjuster. Therefore, the high pressure chamber 78 is gradually collapsed and there occurs a so-called leak-down phenomenon in which the high pressure oil in the high pressure chamber 78 gradually leaks out along the outer wall or the like of the plunger of the lash adjuster 72*a*.

When the engine is re-started with the high pressure chamber 78 nearly collapsed by the leak-down, namely, bottomed, the cam 110 rotates from the cam nose 120 to the base circle and thus, the high pressure chamber 78 of the lash adjuster 100 expands rapidly. At this time, the oil in the reservoir chamber 76 is sucked into the high pressure chamber 78, and it is often the case that along therewith, oil having air mixed therewith which has been introduced from the outside agitates the oil in the reservoir chamber 76 and is mixed therewith. The reservoir oil, thus having air mixed therwith, is directed into the high pressure chamber 78. As a result, the high pressure oil in the high pressure chamber 78 becomes spongy and loses rigidity and thus, the function of the lash adjuster 100 is impaired. Accordingly, the lash adjuster cannot sufficiently follow the high-speed rotation of the engine.

SUMMARY OF THE INVENTION

The present invention has been made with a view to eliminate the above-noted disadvantages peculiar to the prior art, that is, to eliminate the disadvantage that where the plunger and the plunger cap are separate from each other, the control of the press-in force is is difficult, and to eliminate the disadvantage that where the plunger and the plunger cap are integral with each other, the number of assembly steps is increased.

It is also an object of the present invention to provide a valve lash adjuster in which the suction of air into a high pressure chamber is prevented, whereby the lash adjuster is stable in operation and moreover can sufficiently follow the rotation of an engine.

In order to eliminate the above-noted disadvantages, the present invention provides a valve lash adjuster including a body 10 having a bottomed generally cylindrical shape and formed with a high pressure chamber 12, a plunger assembly 20 having a generally cylindrical shape and relatively movably fitted in a hollow portion of said body and having a reservoir 28 for storing operating oil supplied from the outside, and valve means 34 disposed on said plunger assembly and adapted to open to permit the operating oil in said reservoir to flow into said high pressure chamber when said plunger assembly moves in a direction to protrude relative to said body, and to be closed to blcok the operating oil when said plunger assembly moves in the opposite direction relative to said body.

In accordance with the Invention, said plunger assembly is formed with an axial hole 22 on one side of said reservoir in the axial direction thereof for communicating said reservoir with said high pressure chamber and is formed, on the other side of said reservoir, with a first passageway 26 extending axially and communicating said reservoir with the outside and a second passageway 48 branching off from said first passageway and extending to the lower portion of said body at a predetermined angle with respect to said first passageway and opening to the outer peripheral surface of said plunger assembly, and said body is formed with a supply hole 14 for supplying the operating oil correspondingly to the opening portion of said second passageway.

DESCRIPTION OF THE PREFERRED EMBODIMENTS

An embodiment of the present invention will now be described with reference to FIG. 1. This embodiment is of the type in which a plunger 19 and a plunger cap 20 are separate from each other.

Figure 1:
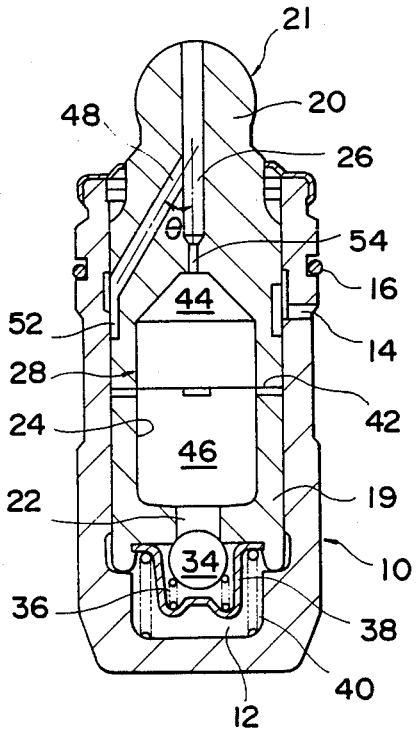
FIG. 1 is a front cross-sectional view showing an embodiment of the present invention.

In FIG. 1, a body 10 is of a bottomed cylindrical shape, a high pressure chamber 12 is formed at the bottom thereof, and a radial operating oil supply hole 14 is formed toward the upper end thereof (as viewed in FIG. 1). A seal member 16 is fitted in an annular groove, as shown.

A plunger assembly 21 has an outer diameter fitted to the inner diameter of the body 10, and a lower axial hole 22. An intermediate reservoir defining portion 24 and an upper axial first passageway 26 (for both supply and lubrication) are formed in the axially central portion of the plunger assembly. The hole 22 opens to the high pressure chamber 12, a reservoir 28 is defined in the containing portion 24, and the passageway 26 leads to the outside. On the outer peripheral surface of the axially intermediate portion, an annular space 52 is formed in a portion corresponding to the supply hole 14.

Within the high pressure chamber 12, a ball 34 is disposed so as to be capable of being seated on the opening peripheral edge of the hole 22, and is biased upwardly by a spring 36. The spring 36 is supported by a spring receiver 38, which is biased upwardly by a spring 40 interposed between the spring receiver 38 and the bottom of the body 10. The reservoir containing portion 24 opens to the circumferential gap between the body 10 and the plunger assembly 21 by means of a radial fine hole 42.

Figure 5:
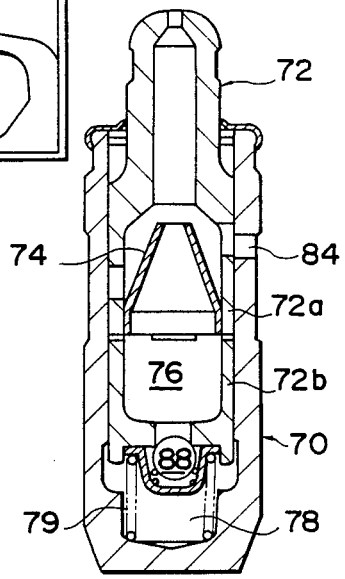
PRIOR ART FIG. 5
FIG. 5 is a front cross-sectional view showing an example of the prior art.

The reservoir 28 comprises a conical portion 44 and a cylindrical portion 46, and is adapted to store operating oil in the internal space thereof. Means corresponding to the earlier discussed separator 74 (see FIG. 5) is not provided.

A suitable number of second passageways 48 (for supply) branch off obliquely from the halfway point of the passageway 26, and open into said annular space 52. The angle $\theta$ formed between the passageways 26 and 48 should desirably be a relatively small acute angle, and is 30° here. Also, the portion of the passageway 26 which is toward the reservoir 28 is reduced in its inner diameter to provide a throttle portion 54.

Operation of the present embodiment will now be described with reference to FIGS. 1 and 4.

The operating oil is supplied from the supply hole 14 into the annular space 52 and is further supplied into the reservoir 28 through the passageways 48 and 26.

Figure 4:
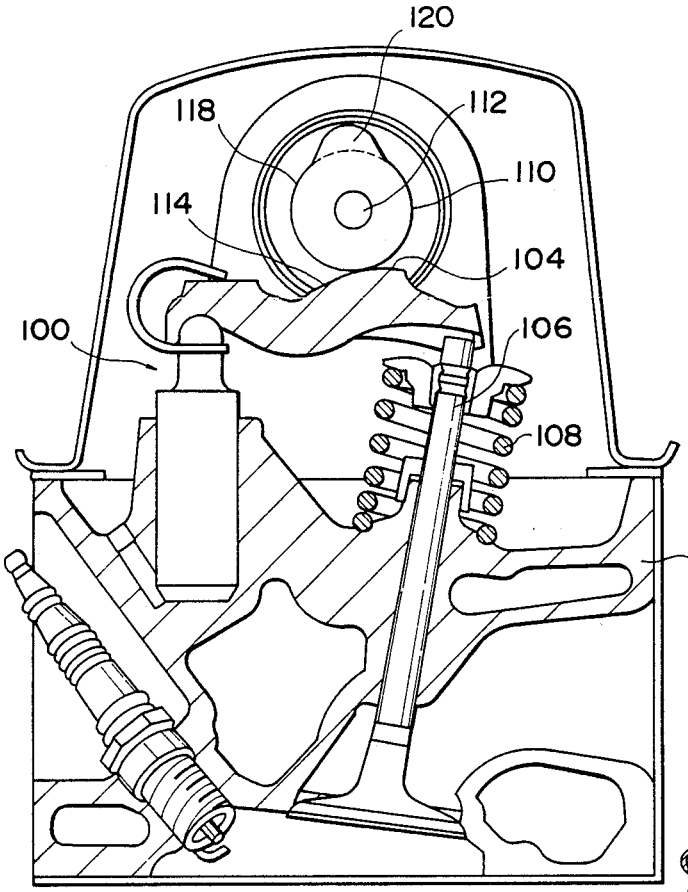
FIG. 4 is a front view showing a mode in which a valve lash adjuster is applied.

Let it be assumed that in the state shown in FIG. 4, a gap is created between the top of the lash adjuster 100 and the swing arm 104. In such case, the plunger assembly 21 is moved away from the body 10, i.e., upwardly as viewed in FIG. 1, by the biasing force of the spring 40, and the ball 34 separates from the opening peripheral edge of the hole 22. Thus, the size of the high pressure chamber 12 becomes larger and the operating oil in the reservoir 46 flows into the high pressure chamber 12 through the hole 22.

As a result, the amount of the operating oil in the reservoir 28 decreases, but the decrement is made up by the operating oil in the reservoir 28 being supplied from the passageways 48, 26. Accordingly, the free extension of the lash adjuster 100 is not hampered.

Here, when the cam 110 of FIG. 4 rotates and the pressure force of the cam nose 120 is produced on the top of the lash adjuster 100, the plunger cap 20 is pushed downwardly. However, the ball 34 is seated on the opening peripheral edge of the hole 22 and thus, the operating oil in the reservoir 28 cannot flow into the high pressure chamber 12. Accordingly, the lash adjuster 100 cannot be reduced in its length.

In the present embodiment, design is made such that the operating oil is supplied from the second passageways 48 extending at an angle of about 30° with respect to the axis of the plunger cap 20 to the axially extending first passageway 26, and the throttle portion 54 is provided in that portion of the passageway 26 which is nearest the reservoir 28. As a result, air is prevented from mixing with the operating oil supplied into the reservoir 28 and thus, the operating oil having air mixed therewith is prevented from whirling in the reservoir 28. Setting said angle $\theta$ to 30° or less is effective to prevent whirling at the branch-off points between the passageways 48 and 26.

Also, the provision of the throttle portion 54 in the passageway 26 effectively prevents any whirl, if created, from flowing into the reservoir 28.

Further, by the cross-sectional area of the passgeways 48 being made somewhat greater than the cross-sectional area of the passageway 26, the loss (the creation of whirl) by a variation in the cross-sectional area of the passageway can be prevented.

The reason why some difference is thus provided between the cross-sectional areas of the passageways is that it is necessary to make the flow rate through the passageways 48 somewhat greater than the flow rate through the passageway 26 because the operating oil supplied from the passageways 48 flows to the top of the plunger cap 20 and lubricates this portion, and also flows in part to the reservoir 28 side to make up for the deficiency of the operating oil therein.

The relation between the angle $\theta$ formed between the passageways 48 and 26 and the loss coefficient with which the operating oil passes through the branch-off points is 0.016, 0.034, 0.042, 0.066, 0.130 and 0.236 when the diameter of the tube is the same and the angle $\theta$ is 5°, 10°, 15°, 22.5°, 30° and 45°, respectively, and the loss is remarkably small at 30° or less.

The present invention is not restricted to the above-described embodiment, but of course may be suitably changed and modified in keeping with the basic principles.

For example, forming the throttle portion 54 in the second passageway 26 is not indispensable, and the passageways 26 and 48 may be identical in their cross-sectional areas.

Figure 2:
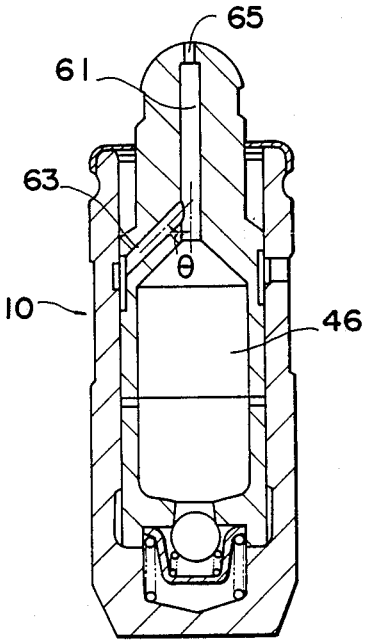
FIGS. 2 and 3 are front cross-sectional views showing another embodiment of the present invention.

Also, as shown in FIG. 2, a passageway 63 may be made to branch off from that portion of a passageway 61 toward the lower end, and the angle $\theta$ formed between the two passageways 61 and 63 may be an acute angle of the order of 40°–50°.

Further, a throttle 65 may be formed near the opening to the outside of that portion of the passageway 61 which is toward the upper end. If this is done, the passageways 61 and 63 for the introduced oil supplied to the lash adjuster 100 will partly communicate with a reservoir chamber 46 and will partly communicate with the oil outlet without the intermediary of the reservoir chamber.

As a result, the oil in the reservoir chamber 46 of the lash adjuster which has very little air mixed therewith can be protected from the air in the introduced oil having much air mixed therewith, and the oil in the reservoir chamber 46 can be kept mixed little with air. Accordingly, during the operation of the lash adjuster, oil having little air mixed therewith can be introduced into the high pressure chamber. Thus, there is obtained a hydraulic type lash adjuster which is stable in operation and which can sufficiently follow even the high-speed rotation of an engine.

Figure 3:
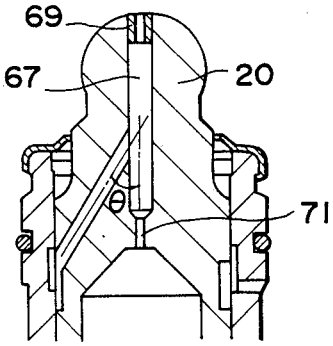

Further, as shown in FIG. 3, throttle portions 69 and 71 may be formed at the lower end and the upper end, respectively, of a passageway 67 of the plunger cap 20.

As described hitherto, according to the present invention, the operating oil is supplied to the reservoir through the first and second passageways forming an acute angle therebetween and therefore, creation of whirl at the branch-off point between the two passageways can be effectively prevented without using a separator as in the prior art. The fact that the separator is unnecessary leads to simplicity of the entire structure.

Also, a throttle portion is provided in the first passageway, whereby even if whirl is created, it is prevented from entering the reservoir.

Further, the cross-sectional area of the second passageway is made greater than that of the first passageway, whereby any loss by a variation in the cross-sectional area of the line in each portion can be prevented.

I claim:

1. A valve lash adjuster comprising:

(a) a hollow body of generally cylindrical shape and formed with a high pressure chamber at a bottom thereof and with a supply hole for supplying operating oil to an interior cylinder portion thereof;

(b) a plunger assembly of generally cylindrical shape relatively movably fitted in said body and having internal means for storing operating oil supplied from the outside through said supply hole of said body, said plunger assembly being formed with an axial hole to a lower side of said storing means for communicating said storing means with said high pressure chamber, and being formed to an upper side of said storing means with a first passageway extending axially of said plunger assembly and providing fluid communication between said storing means and the exterior of said plunger assembly, and with a second passageway branching off downwardly from said first passageway at an acute angle with respect thereto and opening to the outer periphery of said plunger assembly at an opening portion opposed to said supply hole of said body; and (c) valve means disposed near a bottom end portion of said plunger assembly and adapted to open to permit operating oil stored in said storing means to flow into said high pressure chamber when said plunger assembly moves in a direction to protrude relative to said body, and to close to block flow of operating oil from said high pressure chamber to said storage means when said plunger assembly moves in the opposite direction relative to said body.

2. A valve lash adjuster according to claim 1, wherein said first passageway of said plunger assembly has a throttle portion of reduced inner diameter formed between said storing means and the branch-off point of said second passageway from said first passageway.

3. A valve lash adjuster according to claim 1, wherein said first passageway of said plunger assembly has a throttle portion of reduced inner diameter formed near an outlet of said first passageway to the exterior of said plunger assembly.

4. A valve lash adjuster according to claim 1, wherein the cross-sectional area of said second passageway is substantially equal to or somewhat greater than the cross-sectional area of said first passageway.

5. A valve lash adjuster according to claim 1, wherein said acute angle is less than about 60°.

6. A valve lash adjuster according to claim 1, wherein said acute angle is less than about 30°.

* * * * *